US009528353B1

(12) United States Patent
Jani

(10) Patent No.: US 9,528,353 B1
(45) Date of Patent: Dec. 27, 2016

(54) WELLBORE PERFORATING TOOL

(71) Applicant: William Jani, Calgary (CA)

(72) Inventor: William Jani, Calgary (CA)

( * ) Notice: Subject to any disclaimer, the term of this patent is extended or adjusted under 35 U.S.C. 154(b) by 1 day.

(21) Appl. No.: 14/837,428

(22) Filed: Aug. 27, 2015

(51) Int. Cl.

| | |
|---|---|
| ***E21B 43/114*** | (2006.01) |
| ***E21B 34/14*** | (2006.01) |
| ***E21B 23/01*** | (2006.01) |
| ***E21B 33/129*** | (2006.01) |
| *E21B 34/00* | (2006.01) |

(52) U.S. Cl.
CPC ..... *E21B 43/114* (2013.01); *E21B 23/01* (2013.01); *E21B 33/129* (2013.01); *E21B 34/14* (2013.01); *E21B 2034/007* (2013.01)

(58) Field of Classification Search
CPC ..... E21B 43/114; E21B 33/129; E21B 34/14; E21B 23/01; E21B 2034/007
See application file for complete search history.

(56) References Cited

U.S. PATENT DOCUMENTS

| | | | | |
|---|---|---|---|---|
| 2,034,768 | A * | 3/1936 | O'Neill | E21B 43/114 166/128 |
| 3,175,613 | A | 3/1965 | Hough et al. | |
| 5,711,375 | A | 1/1998 | Ravi et al. | |
| 5,765,642 | A | 6/1998 | Surjaatmadja | |
| 6,776,239 | B2 | 8/2004 | Eslinger et al. | |
| 6,832,654 | B2 | 12/2004 | Ravensbergen et al. | |
| 7,331,388 | B2 | 2/2008 | Vilela et al. | |
| 7,617,871 | B2 | 11/2009 | Surjaatmadja et al. | |
| 7,681,654 | B1 * | 3/2010 | Cugnet | E21B 33/124 166/177.5 |

(Continued)

FOREIGN PATENT DOCUMENTS

| | | | |
|---|---|---|---|
| CA | 2578726 | A1 | 8/1998 |
| CA | 2397460 | A1 | 8/2001 |

(Continued)

*Primary Examiner* — Blake Michener
(74) *Attorney, Agent, or Firm* — Gowling WLG (Canada) LLP; D. Doak Horne

(57) ABSTRACT

A downhole tool for perforating a wellbore. A slidable plunger valve is provided, biased to cover jetting ports during run-in of the tool. A compressible packer may be provided below the jetting ports, and a jaw member provided below the packer. A "J" slot and pin arrangement may allow a three-position configuration, namely a run-in position where the packer is uncompressed and jetting ports closed, a set position where the packer is uncompressed and the jaw member forcibly frictionally engaged with the wellbore casing, and a jetting position where the packer is compressed, the tool is supplied with pressurized abrasive fluid, and the plunger valve has uncovered the jetting ports. The plunger valve may be made dual-acting, where during run-in the jetting ports are closed and a bypass port is uncovered, and in the jetting position the jetting ports are open and the bypass port is closed.

9 Claims, 4 Drawing Sheets

(56) References Cited

U.S. PATENT DOCUMENTS

| | | | | |
|---|---|---|---|---|
| 7,686,078 | B2 * | 3/2010 | Khomynets | E21B 43/124 166/250.07 |
| 8,267,199 | B2 | 9/2012 | Buckman, Sr. et al. | |
| 8,770,316 | B2 | 7/2014 | Jelsma | |
| 8,931,557 | B2 * | 1/2015 | Patterson | E21B 23/006 166/177.5 |
| 2002/0162660 | A1 * | 11/2002 | Depiak | E21B 43/26 166/308.1 |
| 2007/0284106 | A1 * | 12/2007 | Kalman | E21B 34/02 166/298 |
| 2008/0210429 | A1 * | 9/2008 | McMillin | E21B 33/13 166/313 |
| 2010/0044041 | A1 * | 2/2010 | Smith | E21B 34/14 166/280.1 |
| 2011/0198082 | A1 * | 8/2011 | Stromquist | E21B 43/114 166/298 |
| 2012/0031615 | A1 * | 2/2012 | Connell | E21B 29/00 166/298 |
| 2012/0205108 | A1 * | 8/2012 | Stang | E21B 43/114 166/298 |
| 2013/0014958 | A1 * | 1/2013 | Jani | E21B 43/26 166/386 |
| 2014/0008071 | A1 * | 1/2014 | Patterson | E21B 23/006 166/308.1 |
| 2014/0069652 | A1 | 3/2014 | Gay et al. | |
| 2014/0158361 | A1 | 6/2014 | Cheng et al. | |
| 2016/0003003 | A1 * | 1/2016 | Getzlaf | E21B 23/02 166/250.07 |

FOREIGN PATENT DOCUMENTS

| | | | |
|---|---|---|---|
| CA | 2466139 | A1 | 11/2004 |
| CA | 2611928 | A1 | 12/2006 |
| CA | 2628802 | A1 | 10/2008 |
| CA | 2693676 | A1 | 7/2010 |
| CA | 2749636 | A1 | 7/2010 |
| CA | 2820652 | A1 | 7/2010 |
| CA | 2843619 | A1 | 7/2010 |
| CA | 2711329 | A1 | 1/2011 |
| CA | 2713611 | A1 | 1/2011 |
| CA | 2746522 | A1 | 1/2011 |
| CA | 2797934 | A1 | 1/2011 |
| CA | 2777429 | C | 4/2011 |
| CA | 2732062 | A1 | 5/2011 |
| CA | 2738907 | | 7/2011 |
| CA | 2766026 | A1 | 7/2011 |
| CA | 2852311 | A1 | 4/2012 |
| CA | 2788985 | A1 | 3/2013 |
| CA | 2799967 | A1 | 6/2013 |
| CA | 2798343 | A1 | 9/2013 |
| CA | 2848627 | A1 | 10/2014 |
| CA | 2820704 | A1 | 1/2015 |
| CA | 2856184 | A1 | 1/2015 |
| CA | 2873541 | A1 | 6/2015 |

* cited by examiner 12
38
16
16
26
44
65
40
20
36
'X'
34
62 running in
12
16
16
44
65
30
46
18"
18"
34
'Y'
34
36
60
62 set position
12
22
65
20
32
36
'Z'
34
34
12
60
12 jetting
position running-in set position jetting position

WELLBORE PERFORATING TOOL

FIELD OF THE INVENTION

The present invention relates to a downhole tool for well completion, and more particularly to a downhole tool for perforating a wellbore in an underground hydrocarbon formation, prior to fracking and/or hydrocarbon recovery from such wellbore.

BACKGROUND OF THE INVENTION AND DESCRIPTION OF PRIOR ART

This background information is provided for the purpose of making known information believed by the applicant to be of possible relevance to the present invention.

No admission is necessarily intended, nor should be construed, that any of the preceding information, or the reference in the drawings to "prior art" constitutes prior art against the present invention.

When a well has been drilled in an underground hydrocarbon formation, the well is typically lined with cylindrical hollow casing (typically steel) to prevent collapse of the drilled well. Thus in order to "complete" a well in preparation for production of hydrocarbons from such cased well, the casing liner of the wellbore must first be perforated to allow hydrocarbons to be able to flow into the well.

Perforation of the wellbore casing must also precede the further "completion" step which is now typically carried out during most modern well completions, namely the further step of injecting a fracking fluid into the hydrocarbon formation via perforations in the wellbore casing, to thereby fracture the formation in the region of the well so as to create better recovery conditions and assist in flowing hydrocarbons out of the formation and into the wellbore.

Wellbore perforation has to date been conducted in three principle manners.

Firstly, wellbore perforations can be carried out by way of mechanical punch tools, which when inserted into a cased well and positioned at desired locations along a wellbore, punch a series of apertures in the steel casing at such locations where actuated to thereby perforate the casing.

Alternatively, casing perforation can be accomplished by way of detonation of explosive shaped charges at specific desired locations along a wellbore. In such method shaped explosive charges are inserted down a wellbore and electrically actuated to as to perforate the steel wellbore in the region of the placement of the shaped charges.

Alternatively, wellbore perforation can be accomplished by the use of a jetting tool which is inserted in the wellbore. An abrasive jetting fluid is supplied under high pressure to the jetting tool when positioned at a desired location along the wellbore. The jetting tool directs the jetting fluid outwardly in a pressure jet which impinges against the steel casing. Due to the continued abrasion of the directed high pressure jet against the side of the casing, the casing is perforated in the region of the jet(s).

U.S. Pat. No. 3,175,613 entitled "Well perforating with abrasive fluids", teaches one method of perforating a wellbore using an abrasive jet which contains sand, an liquid, and a gas such as carbon dioxide or nitrogen, which is used as the jetting fluid.

Jetting tools and techniques for perforating wellbores using pressurized abrasive fluids have generally been improved upon over the years.

For example, Canadian Patent Application 2,873,541 entitled "Fracturing Valve and Fracturing String" teaches a downhole tool 200 used for both perforating a wellbore and further fracking the formation via the perforations created in the wellbore. A sliding mandrel 15, a frac port 60 which may be opened and closed by mandrel 15 acting as a valve, a compressive packer 121 located on the tool downhole of frac port 60, a "j' slot 123, and a plurality of jetting nozzles 12 located at an upper end of tool 200, all incorporated into tool 200. FIGS. 7*a*, 8 & 9 show successive sequences in the positioning and operation of the tool 200 during "run-in" (FIG. 7*a*), "perforating" (FIG. 8), and "fracking" (FIG. 9). Specifically, the frac port 60 comprises a window on a tubular 1, and an outer sleeve is disposed around the tubular which is slidable relative to the tubular, the outer sleeve having a port, wherein for (frac) fluid to exit the valve the window and port must each be aligned by relative movement to each other. Disadvantageously, however, the jetting nozzles 12 on such tool 200 have no means of being closed to prevent ingress of detritus and cuttings during "run-in" of tool 200 into the wellbore.

Canadian patent application CA 2,738,907 entitled "Tools and Methods of Use in Completion of a Wellbore" teaches a sand jetting tool 100 having an abrasive jet assembly 10, a 'j' slot, and a single compressible seal 11 (FIG. 1*a*). The method disclosed therein is directed to an embodiment having a moveable slidable sleeve 41 secured by a shear pin, and using a locator to grip the sleeve 41 with slips to move sleeve 41 to open jetting ports 42, as shown in FIG. 4*a*, 4*b* thereof. Disadvantageously, therefore, the jetting ports 42 must be opened by inserting a special locator tool into the wellbore.

Canadian patent CA 2,693,676 teaches a sand jet tool 30 having a ball-actuated sandjet port, and an expandable packer 31 that is actuated by a "j" slot. The tool 30 has a debris relief passageway that is operatively associated with the 'j' slot and actuated (opened and closed) by movement of the 'J' slot.

Canadian patent 2,713,611 teaches a perforating and fracking tool having a sandjet perforating assembly 80, a "j"-slot for actuating resettable anchor device 41, and a bypass plug operating as a valve which allows equalization of pressure in a straddle zone 10 between cup seals 20, 30, to release pressure, when desired, between cup seals 20, 30, as shown in FIG. 1.

U.S. Pat. No. 6,394,184 teaches a system and method for perforating and fracking a formation having a wellbore therein. Although perforating guns 136,146,156 are shown in some of the drawings, the disclosure teaches that the "perforating means" may also comprise an abrasive fluid-jet cutting device (ref. page 11, lines 13-15 and page 37, lines 5-6) and further in FIG. 10 thereof depicts such a device 310.

US publication 2014/0158361 relates to a multi-shift frac sleeve system 10 which uses a pressure actuated spring-biased sleeve 22 for opening and closing a frac port 18, which may be further actuated to move to a third position (FIG. 4) where frac port 18 is closed, as may be seen from FIGS. 2-5 thereof. It teaches a pin 20 and 'j' slot 27 for controlling shifting of inner sleeve 14. Again, to open the frac ports 18, such patent application teaches an outer sleeve and an inner sleeve where the ports therein must be aligned in order for passage of fluid therethrough.

Canadian patent 2,611,928 teaches layers of staggered jet nozzles, wherein the jetting fluid is further used to frac the formation.

Canadian patent application CA 2,843,619 titled "Downhole Tool Assembly with Debris Relief and Method for using Same" as per CA 2,693,676 (above) makes similar disclosure as CA 2,693,676, but requires that the debris relief valve be actuated by movement of the tool up or down, and not by a pressure differential.

CA 2,856,184, similar to CA 2,873,541, relates to a downhole tool capable of performing both abrasive jet perforation as well as fracturing, with a valve portion made up of a tubular mandrel having a through bore continuous with a tubing string, and a frac window through the side of the tubular mandrel. Jet nozzle 98 is used for perforating (with the frac port closed and seal 121 deactivated) as shown in FIG. 11A thereof. FIG. 11B shows the tool moved upwardly so that the frac window is open and positioned next to the created perforations 98 for fracking (seal 121 is activated). Again, the tubular and sleeve are each axially moveable relative to one another, and the valve is move to the closed position by applying a mechanical force to the tubular (i.e. raising it upwardly), as shown in FIG. 8, as opposed to the application of fluid pressure to the upper region of the tool CA 2,224,571/U.S. Pat. No. 5,765,642 teaches a jetting tool having an expandable packer, having at least one fluid jet forming nozzle, wherein the jetting fluid is used to further frac the formation.

SUMMARY OF THE PRESENT INVENTION

Despite the above publications relating to jetting tools for wellbore completion, there is still a need in the industry for an effective jetting tool that is able to relatively quickly and reliably perforate a length of wellbore without having to do make in a number of successive trips down the wellbore.

It is thus an object of the present invention to provide an effective jetting tool for quickly and effectively perforating a wellbore during completion of such wellbore.

In some embodiments, it is an object to provide a tool which reduces and/or allows re-use of the jetting fluid being used, to thereby minimize the quantum of such fluid needed to perforate the wellbore.

In other embodiments, it is an object to provide a perforation tool that has a bypass port to assist in introducing the perforating tool into the wellbore and positioning it at the desired location along the wellbore.

It is a further object of the present invention to provide a jetting tool of a configuration which minimizes the prospect of such tool becoming sanded in within a wellbore during a sandjetting/perforation process and accordingly being incapable of being withdrawn from the wellbore.

It is still a further object of the present invention to provide a jetting tool which has biased means for maintaining the jetting ports in a closed position to thereby avoid inadvertent entry into the tool of fines, residual drill tailings or cuttings or other detritus, in the absence of a flushing fluid being present.

It is a still further object of the present invention to provide a tool in which the sand jetting ports used for perforating the casing may further subsequently immediately thereafter be used for injecting a fracking fluid into the formation via the created perforations in the casing.

It is still a further object of the present invention to provide a jetting tool which has internal pressure-actuated means for opening the jetting ports, and does not require mechanical up/down motion of the tool within the wellbore in order to open such jetting ports.

Accordingly, in order to provide inter alia the above objects, in a first broad embodiment the present invention provides a perforating tool for perforating a cased wellbore, comprising:

(i) a tubular mandrel;

(ii) a jetting port situated within a periphery of said tubular mandrel, which port when open allows a jetting fluid from an interior of said tubular mandrel to be radially directed outwardly in a jet; and (iii) a spring-biased plunger valve, slidably moveable within said tubular mandrel, preventing fluid flow from uphole through said tubular mandrel in a downhole direction, biased to slidably cover said jetting port, which plunger valve when pressurized jetting fluid is supplied to an upper end of said tubular mandrel sufficient to overcome said spring-bias, slidably moves in said tubular mandrel so as to uncover said jetting port and allow said pressurized jetting fluid to flow radially outwardly from said jetting port and perforate said cased wellbore.

Advantageously with a jetting tool of the above configuration, the jetting ports remain closed (covered) during run-in of the tool into the wellbore, thereby allowing fluids containing detritus such as drilling fines to be flushed up the wellbore annulus which exists between the tool and the wellbore, thereby reducing the tendency of fines and sand which may otherwise remain to cause sanding-in of tool within the wellbore and such tool thereby being unable to be removed from the wellbore.

In a greatly preferred embodiment, the perforating tool is further provided with a packer member which when compressed expands so as to create a seal between the tool and the wellbore, to prevent abrasive jetting fluid from flowing downhole in the annulus between the tool and the casing, and allowing such sand to be forced uphole and thus recovered for re-use. An added benefit of recovering such abrasive fluid uphole is that such abrasive fluid, which typically contains sand as the abrasive component of the fluid, thus reduces the amount of sand downhole to allow better flow, and thus reducing the chance other tools which may be inserted downhole will become sanded in. Still further, the use of a perforating tool which further has a packer r may allow the sand jetting ports to be subsequently used for injecting a fracking fluid into the formation via the created perforations in the wellbore by likewise preventing such fracking fluid from escaping downhole.

Accordingly, in a broad aspect of such greatly preferred embodiment, the present invention comprises a perforating tool for perforating a cased wellbore, having:

(i) a tubular mandrel;

(ii) a jetting port situated at an upper end of said mandrel within a periphery of said tubular mandrel;

(iii) a compressible packer member positioned on said tubular mandrel below said jetting port;

(iv) a jaw member, fixedly secured to a pin member, slidably positioned on said tubular mandrel below said packer member and radially outwardly extendable when forced by a wedge-shaped member on said mandrel so as to frictionally engage said cased wellbore; and (v) a 'j' slot for guiding and containing therewithin said pin member, said "j' slot located on said tubular mandrel below said packer member and adapted to guide said pin member therein to move from a "run-in" position, subsequently to a "set" position, and lastly to a "jetting" position;

wherein when said pin member in said 'j'-slot is in said "run-in" position said compressible packer member is uncompressed and said jaw member does not forceably frictionally engage said cased wellbore;

wherein when said pin member in said 'j'-slot is repositioned therein from said "run-in" position to said "set" position by pulling in an uphole direction on said tool said tubular mandrel slides upwardly relative to said jaw member; and wherein when said pin member in said 'j'-slot is moved to said "jetting" position said tubular mandrel is allowed to slide relative to said jaw member so as to compress said compressible packer member and further cause said wedge-shaped member on said tubular mandrel to force said jaw member radially outwardly and in frictional engagement with said cased wellbore; and (vi) a spring-biased plunger valve, slidably moveable within said tubular mandrel, preventing fluid flow from uphole through said tubular mandrel in a downhole direction, biased via a spring to slidably cover said jetting port, which plunger valve when pressurized jetting fluid is supplied to said upper end of said tubular mandrel at sufficient pressure to overcome said spring bias, slidably moves downward in said tubular mandrel so as to uncover said jetting port and allow said pressurized jetting fluid to flow radially outwardly therefrom and perforate said casing.

In a further refinement of the above embodiment, the perforating tool of such embodiment further comprises a bypass port situated in said tubular mandrel above said compressible packer, when open providing fluid communication between an exterior of said tool above said compressible packer and an interior of said tool below said compressible packer. The spring-biased plunger valve is a dual-acting plunger valve, biased via said spring to slidably cover said jetting port and to leave uncovered said bypass port, but when fluid pressure is supplied to said upper end of said tubular mandrel sufficient to overcome said spring bias, to slidably move within said tubular mandrel to uncover said jetting port and to simultaneously close said bypass port.

In a still further embodiment, an upper portion of said spring-based plunger is an upwardly-facing cone which directs said jetting fluid substantially uniformly to each of said circumferentially-spaced jetting ports.

In a still further embodiment of the present invention, such invention comprises a wellbore completion tool for perforating a casing of a cased wellbore, having:

(i) a tubular mandrel;

(ii) at least a pair of jetting ports situated at an upper end of said mandrel, positioned within a periphery of said tubular mandrel and in a plane substantially perpendicular to a longitudinal axis of said tubular mandrel;

(iii) a dual-acting spring-biased plunger valve, slidably moveable within said tubular mandrel, preventing fluid flow from uphole through said tubular mandrel in a downhole direction, biased to slidably cover said at least a pair of jetting ports when in a closed position, which when fluid pressure is supplied to said upper end of said tubular mandrel slidably moves to uncover said jetting ports;

(iv) a compressible packer member;

(v) a 'j' slot, located on said mandrel below said packer member, adapted to allow a pin member therein to move in a "run" position, a "set" position, and a "jetting" position;

(vi) a jaw member, positioned on said tubular member below said packer member, radially outwardly extendable when forced by a wedge-shaped element on said mandrel so as to frictionally engage said casing;

(vii) a bypass port situated in said tubular mandrel above said compressible packer;

(viii) a lower portion of said dual-acting plunger valve configured to uncover said bypass port and thereby allow fluid communication between an exterior of the tool uphole of the packer member and a hollow interior of said mandrel below said packer member when said dual-acting valve is in a position covering said jetting ports, and to close said bypass valve when said dual-acting valve is in a position uncovering said jetting ports;

wherein when said pin member in said 'j'-slot is moved to said "run-in" position said compressible packer member is uncompressed and said jaw member is not forceably frictionally engages said casing; and wherein when said pin in said 'j'-slot is moved to said "jetting" position said wedge shaped member compresses said compressible packer member and further forces said jaw member radially outwardly and in frictional engagement with said cased wellbore.

In preferred embodiments of the perforating tool, such tool comprises a plurality of jetting ports within a periphery of the tubular mandrel, all in a plane substantially perpendicular to a longitudinal axis of said tubular mandrel.

Where a plurality of jetting ports are used, such advantageously allows the creation of a series of perforations in the wellbore casing, for a single positioning of the tool at a longitudinal position within the wellbore.

Preferably, where a plurality of jetting ports are incorporated into the tool of the present invention, the jetting ports are uniformly and circumferentially spaced around said periphery.

The above summary of various aspects and embodiments of the invention does not necessarily describe the entire scope of the present invention. Other aspects, features and advantages of the invention will be apparent to those of ordinary skill in the art upon a proper review of the entire description of the invention as a whole, including the drawings and consideration of the specific embodiments of the invention described in the detailed description.

BRIEF DESCRIPTION OF THE DRAWINGS

For purposes of this disclosure and specification, including the claims, terms of direction and location used in this specification including the claims to specify location of components on the tool are with reference to the tools when placed in a vertical wellbore, although the tool is not restricted to being used in a vertical wellbore and may be placed in a deviated or horizontal wellbore.

For example, the terms "upper", "upwardly", "uphole", "downhole", "above", "below", and "lower" are with respect to the tool of the present invention, or relative positioning along the tool, when such tool is placed in a vertical wellbore.

Figure 1A:
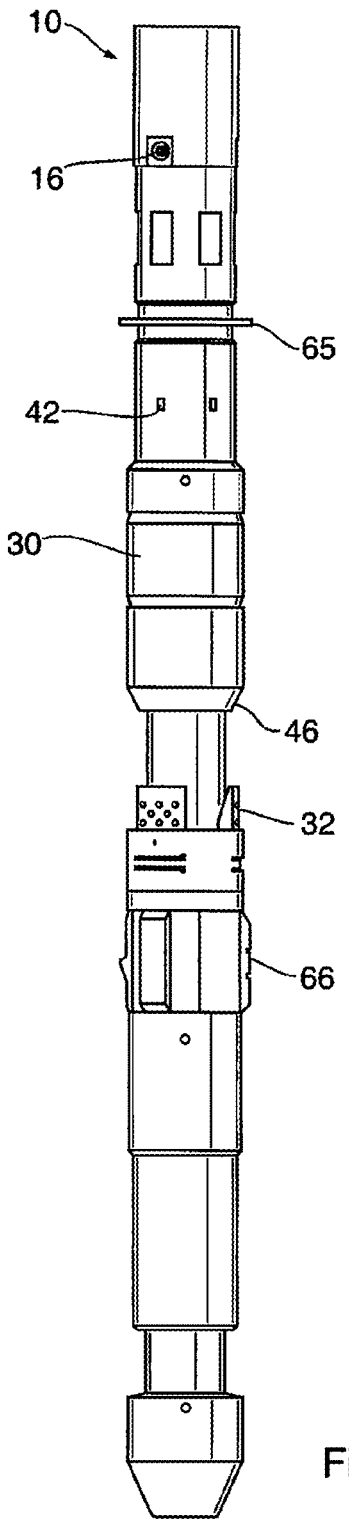
Figure 1B:
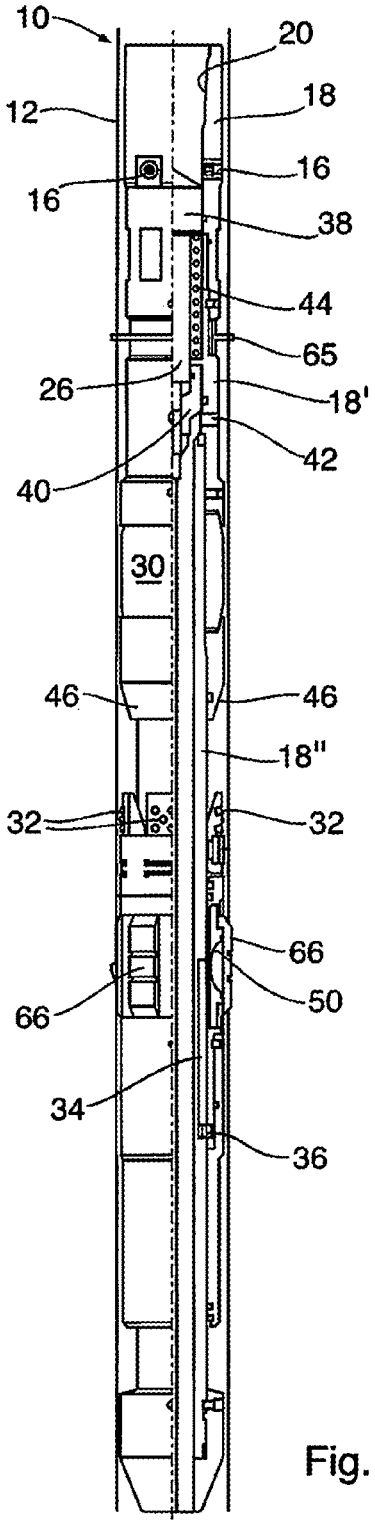
Figures 2A, 2B, 2C:
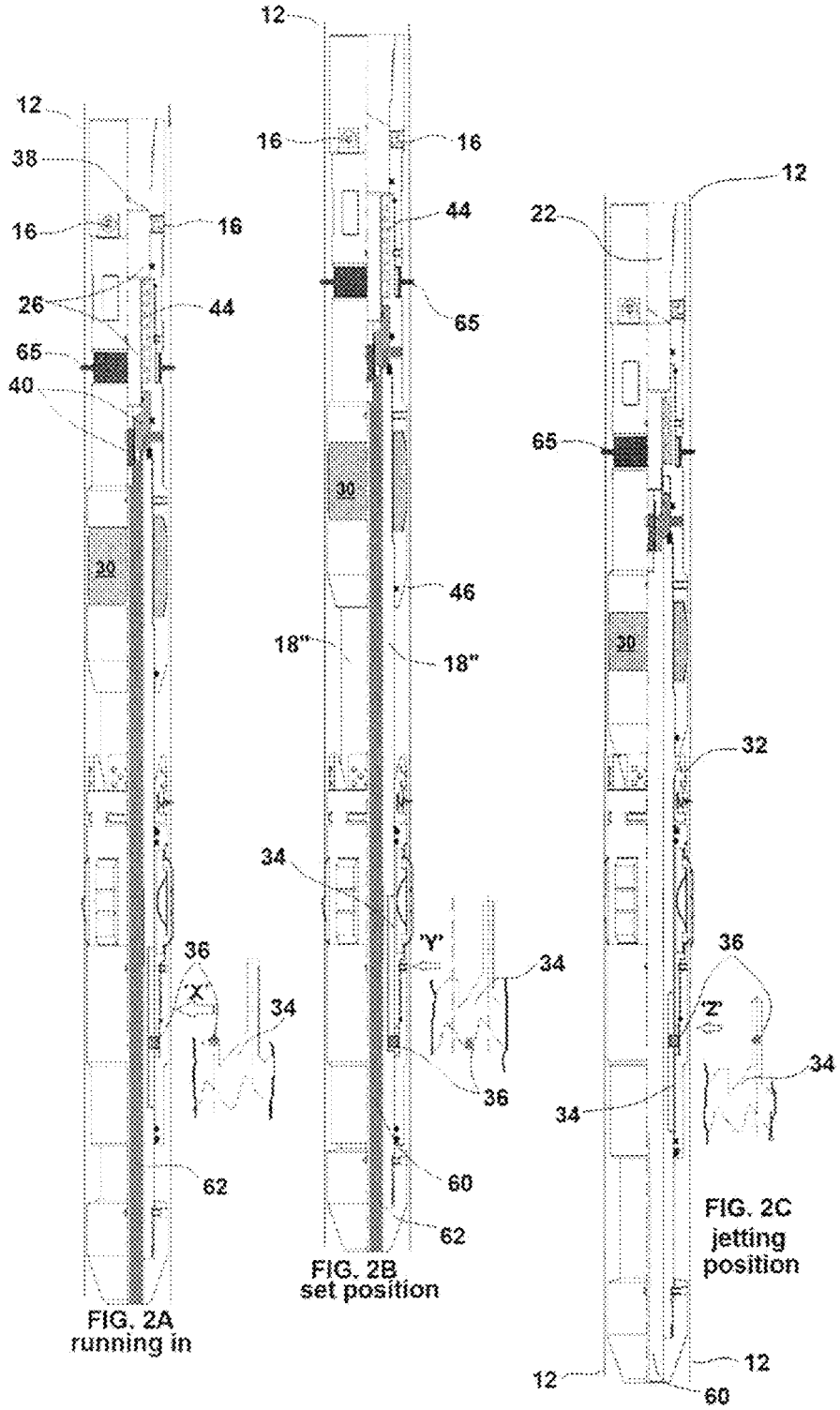
Figures 3A, 3B, 3C:
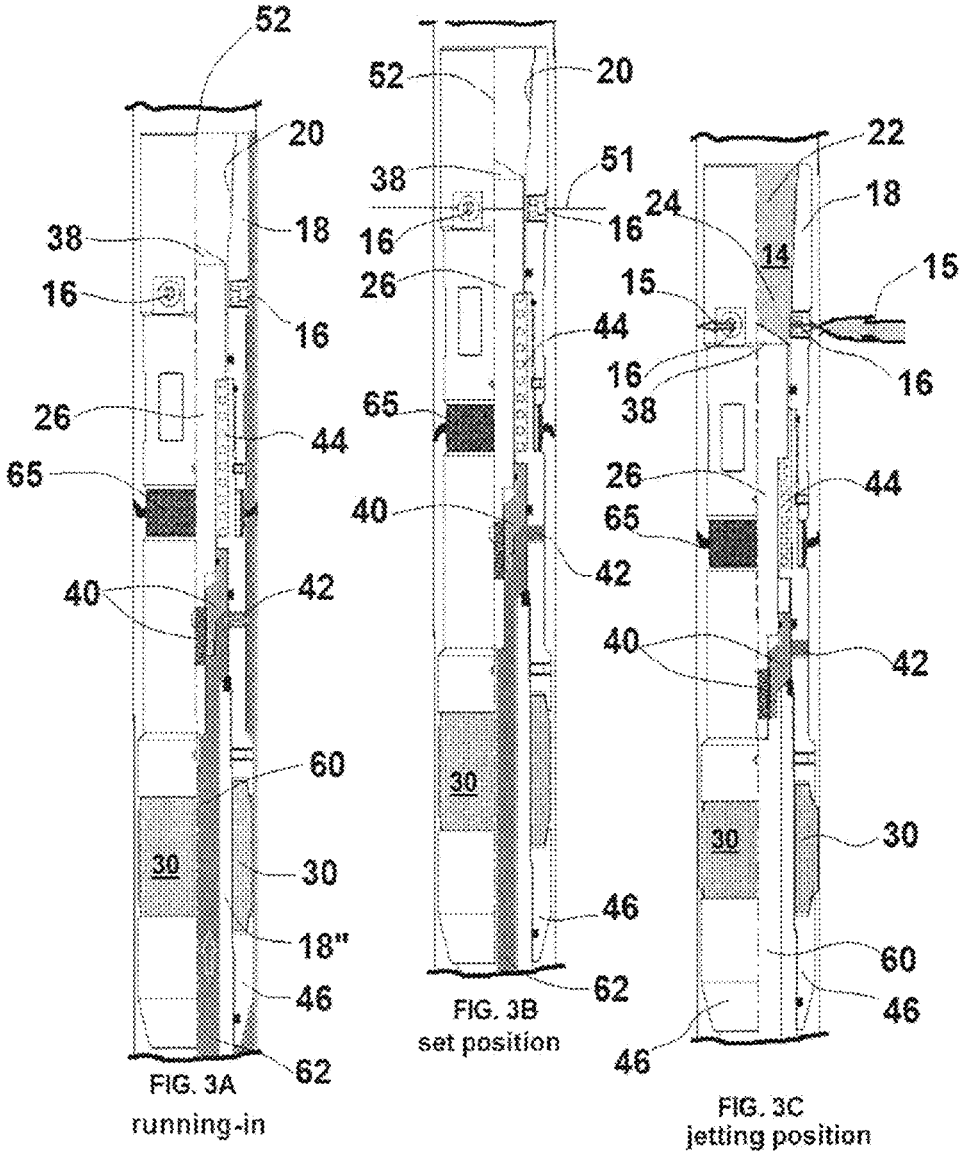
Figure 4A:
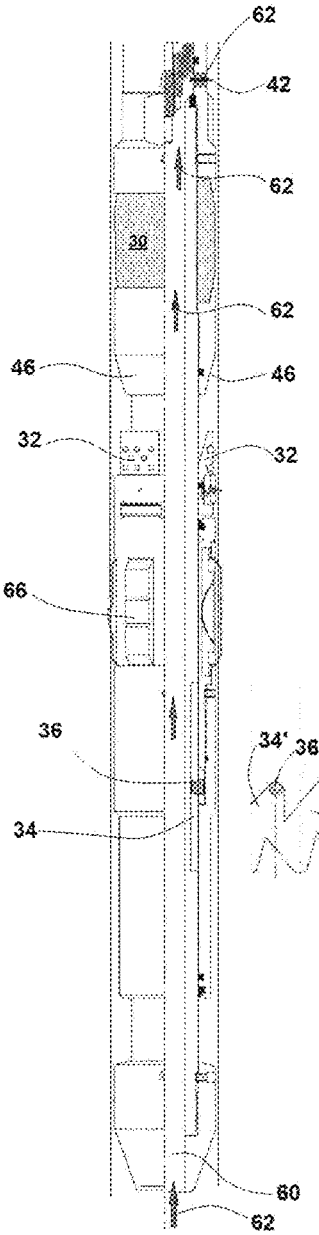
Figure 4B:
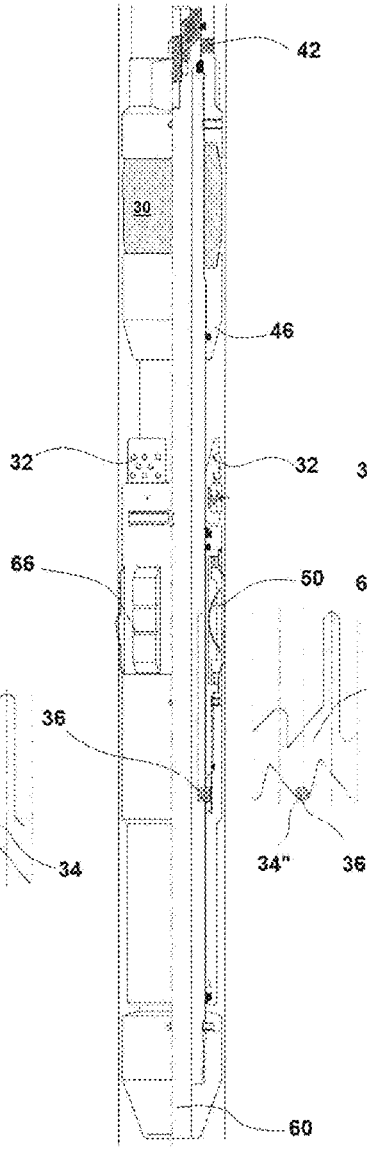
Figure 4C:
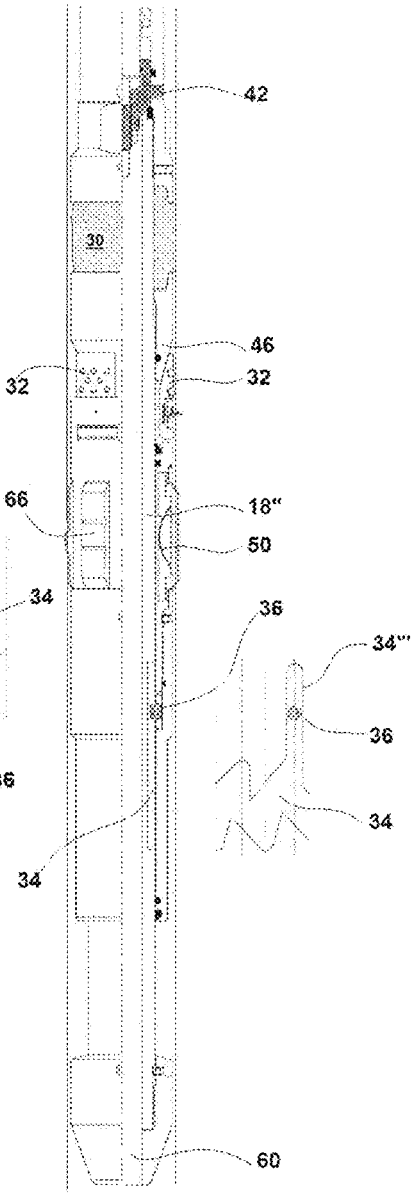

The following drawings figures depict preferred and non-limiting embodiments of the invention, in which:

FIG. 1A is an exterior view of a preferred embodiment of the perforating tool of the present invention utilizing a plurality of jetting ports, a dual-acting plunger valve (not viewable from the exterior) a compressible/expandable packer member, a jaw member for temporarily anchoring the tool in the wellbore, and a bypass port, when such perforating tool is in the run-in position;

FIG. 1B is a partial sectional view of the perforating tool of FIG. 1A, showing the tool in the run-in position;

FIGS. 2A, 2B, and 2C show sequential relative positions of the tool within a wellbore, namely for running-in the too within the wellbore, for setting the tool within the wellbore, and the position and configuration thereof for perforating the wellbore, respectively, wherein:

FIG. 2A is a partial sectional view of the perforating tool of FIG. 1A similar to that of FIG. 1B, showing the tool when in the "running in" position, further showing a view in the direction of arrow "X" on the 'j'-slot and the position of the pin member therein when in the "running-in" position;

FIG. 2B is a partial sectional view of the perforating tool of FIG. 1A, when the tool is in the jaw "set" position, further showing a view in the direction of arrow "Y" on the 'j'-slot and the position of the pin member therein when in the "set" position;

FIG. 2C is a partial sectional view of the perforating tool of FIG. 1A, when the tool is in the jetting/perforating position, further showing a view in the direction of arrow "Z" on the 'j'-slot and the position of the pin member therein when in the "set" position;

FIGS. 3A, 3B, and 3C show enlargements of an upper portion of the tool as seen in each of respective FIGS. 2A, 2B, and 2C, wherein:

FIG. 3A is an enlarged view of the upper portion of the tool, when in the "run-in" position as shown in FIG. 2A;

FIG. 3B is an enlarged view of the upper portion of the tool, when in the "set" position as shown in FIG. 2B:

FIG. 3C is an enlarged view of the upper portion of the tool, when in the "jetting" position as shown in FIG. 2C:

FIGS. 4A, 4B, and 4C show enlargements of a lower portion of the tool as seen in each of respective FIGS. 2A, 2B, and 2C, wherein:

FIG. 4A is an enlarged view of the lower portion of the tool when in the "run-in" position as shown in FIG. 2A, again further showing by way of an adjacent side elevation view, the 'j'-slot and the position of the pin member therein when in the "running-in" position;

FIG. 4B is an enlarged view of the lower portion of the tool, when in the "set" position as shown in FIG. 2B, again further showing by way of an adjacent side elevation view, the 'j'-slot and the position of the pin member therein when in the "set" position; and FIG. 4C is an enlarged view of the lower portion of the tool, when in the "jetting" position as shown in FIG. 2C, again further showing by way of an adjacent side elevation view, the 'j'-slot and the position of the pin member therein when in the "jetting" position.

DETAILED DESCRIPTION OF SOME OF THE PREFERRED EMBODIMENTS OF THE PRESENT INVENTION

FIGS. 1A, 1B, 2A, 2B, 2C, 3A, 3B, 3C, and 4A, 4B, 4C show a preferred embodiment of perforation tool 10 of the present invention, for perforating a casing 12 of a wellbore. Casing 12 is typically comprised of a plurality of hollow cylindrical segments (not shown) usually of high strength steel, which are threadably coupled together and line the wellbore.

Tool 10, when supplied with pressurized abrasive jetting fluid 14, exudes such high pressure abrasive fluid 14 radially outwardly in a jet 15 via one or more jetting ports 16 so as to thereby perforate the casing 12. Preferentially, tool 10 comprises not just one but rather a plurality of jetting ports 16 uniformly and circumferentially spaced around a periphery of tubing mandrel 18, in a plane 51 substantially perpendicular to a longitudinal axis 52 of tool 10.

Tool 10 comprises a tubular mandrel 18, which itself typically comprises a number of tubular segments 18', 18" threadably connected together. Tool 10 is adapted to be threadably coupled via coupling threads 20 at an upper end 22 thereof to an end of coiled tubing or production tubing (not shown), and inserted downhole in casing 12.

At least one jetting port 16, and preferably a plurality of jetting ports 16, are situated on a periphery 20 of tubular mandrel 18 of tool 10. Jetting ports 16, when uncovered (i.e. when jet ports 16 are thus open) allow jetting fluid 14 from an interior 24 of tubular mandrel 18 to be radially directed outwardly in a jet 15 (see FIG. 3C) to perforate casing 12.

While tool 10 shown in the drawings is consistently shown as having a compressible packer member 30, jaw members 32 for frictionally and forceably engaging the side of casing 12, a 'j'-slot 34 (as further discussed below), and a pin member 36 moveable in 'j'-slot 34 as further discussed below, these additional components are only present in preferred embodiments and only provide further capabilities and improve the operation of tool 10. Tool 10, however, in its broadest configuration does not possess nor need to possess these additional components and simply comprises jetting ports 16 which are adapted to be covered by a single acting spring-biased plunger valve 26, which plunger valve 26 is adapted, when a pressurized fluid 14 is supplied to an upper end 22 of tool 10, to move downwardly to thereby uncover jetting ports 16 and allow jetting fluid 14 to be forceably ejected from jetting ports 16 in a jet 15 (see FIG. 3C).

Likewise, in the embodiment of tool 10 shown in the drawings spring-biased plunger valve 26 is dual-acting. Specifically, spring biased plunger valve 26 is configured such that when an upper end 38 thereof is slidably positioned to cover jetting ports 16 simultaneously at a lower end 40 thereof such plunger valve uncovers and thus opens a bypass port 42. Similarly when an upper end 38 of plunger valve 26 is slidably positioned to uncover jetting ports 16, lower end 40 thereof covers bypass port 42 so as to thereby close bypass port 42. Again, however, tool 10 in its broadest configuration may not possess a bypass port 42, and/or the plunger valve 26 may not be dual-acting and only single acting to simply open and close jetting ports 16.

Thus in its broadest embodiment, tool 10 comprises a spring-biased plunger valve 26 which is slidably moveable within tubular mandrel 18 from a first position in which a spring 44 biases such plunger valve 26 so as to cover jetting ports 16 (see FIGS. 2A, 2B and FIGS. 3A,3B) to a second position (ref. FIGS. 2C and 3C) in which pressurized fluid 14 provided to an upper end 22 of tool 10 via coil or production tubing overcomes a biasing force exerted by spring 44 and causes plunger valve 26 to move downwardly in tool 10 so as to uncover jetting ports 16.

Advantageously, therefore, in its broadest embodiment tool 10 is able to maintain jetting ports 16 closed during run-in of tool 10 into casing 12 and thus prevent during such run-in any residual fines, sand, drill tailings, and/or other detritus within a wellbore from flowing into interior 24 of tool 10 via jetting ports 16 which detrimentally would otherwise cause plugging of jetting ports 16 and thereby prevent tool 10 from subsequently being able to perforate casing 12.

Moreover, and also advantageously by virtue of such arrangement, jetting ports 16 may easily be subsequently opened without the need to use any other tool or need to withdraw tool 10 from casing 12, merely by provision of an abrasive jetting fluid 14 from uphole to interior 24 of tool 10, which then overcomes biasing force exerted on plunger valve 26 to cause plunger valve 26 to move slidably downwardly in tool 10 so as to uncover jetting ports 16 and allow perforation of casing 12 at the location of the tool 10 within casing 12.

In a preferred embodiment, and with reference to the drawings figures, tool 10 as mentioned above advantageously is further provided with a compressible packer member 30, jaw members 32 for frictionally and forceably engaging the side of casing 12, a 'j'-slot 34 (as further discussed below), and a pin member 36 moveable in 'j'-slot 34. A radial compressible packer member 30, typically of a compressible vulcanized rubber as may be commonly purchased, is positioned on tubular member 18 of tool 10, below jetting ports 16. At least one jaw member 32, which is fixedly secured to a pin member 36, is slidably positioned on tubular mandrel 18 below packer member 30. Jaw member 32 is radially outwardly extendable when forced by a wedge-shaped member 46, as shown in each of "jetting" positions illustrated in FIGS. 2C, 3C, and 4C, to permit the tool 10 to be forceably and frictionally engaged with casing 12, so as to secure longitudinally tool 10 within casing 12 when conducting the jetting (casing perforation step), as shown in FIG. 2C and in greater detail in FIG. 4C.

A 'j'-slot 34 is located on and within tubular mandrel 18 below packer member 30. 'J'-slot 34 comprises a number of channels 34', 34" and 34" for guiding and containing therewithin pin member 36, and in particular provides three (3) positions for such pin member 36 therein, namely in a first "run-in position (see FIG. 2A and in enlarged view in FIG. 4A), in a "setting" or "set" position (FIG. 2B and in enlarged view in FIG. 4B), and finally in a "jetting" position (FIG. 2C and in enlarged view in FIG. 4C).

Due to the slidable configuration of tubing mandrel 18 of tool 10 within jaw members 32, when pin 36 in 'j'-slot 34 is in the "run-in" position within casing 12 compressible packer 30 is uncompressed and wedge-shaped member 46 immediately below packer 30 does not forceably engage jaw members 32. Thus jaw members 46 do not forceably frictionally engage casing 12, although light frictional engagement of jaw members 32 or other slidable "slips" 66 with casing 12 is typically always provided, such as by leaf springs 50 which cause for example slips 66 to be in constant frictional engagement with interior of casing 12 to thereby allow best operation of "j" slot 32 in the manner hereinafter described. Such light frictional engagement permits being able to reposition pin member 34 in 'j' slot 34 and thus reconfigure tool 10 from a "run-in" position (FIG. 2A), to a "set" position (FIG. 2B), and thereafter to a "jetting position" (FIG. 2C).

Specifically, during run-in, pin member 24 is typically within one channel 34' of 'j' slot 34, and further slidable movement of tubular 18 relative to jaw members 32 is prevented by pin member 36 contacting an extremity of channel 34', as best shown in FIG. 4A.

Thereafter, by lifting up on tool 10, namely by pulling in an uphole direction on tool 10 tubular mandrel 18 slides relative to jaw member 32 which remains frictionally located in casing 12, thereby causing pin member 36 to be repositioned within 'j' slot 34 and travel to second channel 34", where further upward motion of tool 10 is then limited by pin member 36 reaching an opposite extremity in channel 34" (see FIG. 2B, 3B, and as best shown in FIG. 4B).

Thereafter, by again then pushing down on upper end 22 of tool 10 pin member 36 in channel 34'" of 'j'-slot 32 is moved to said "jetting" position (see FIGS. 2C, 3C and 4C), causing tubular mandrel 18 and wedge-shaped member 46 thereon to slide relative to said jaw member 32 and contact jaw member 32 so as to compress compressible packer 30 and further force said jaw member 46 radially outwardly and in frictional engagement with casing 12 to stabilize and secure tool 10 in casing 12 during supply of high pressure fluid to tool 10. The pressurized fluid causes plunger valve 26 to move so as to uncover jetting ports 16, thus allowing jet perforation of casing 12.

In a further preferred embodiment, shown in all drawings figures, a bypass port 42 is situated in tubular mandrel 18 above compressible packer 30. When open, bypass port 42 provides fluid communication between an exterior of said tool 10 above compressible packer 30 and an interior 60 of tool 10 below compressible packer 30, which bypass port 42, during insertion (run-in) of the tool 10 into a fluid-filled casing 12, when open allows fluid 62, (i.e. liquid or gas) to bypass compressible packer 30 on tool 10 and travel uphole, thereby allowing tool 10 to move further downhole in casing 12.

In such embodiment, spring-biased plunger valve 26 may further be a dual-acting plunger valve, biased via said spring to slidably cover jetting ports 16 at an upper end 38 thereof and to simultaneously leave uncovered bypass port 42 at a lower end 40 thereof when in the "run-in" position (FIGS. 2A, 3A, & 4A). Then, when pressurized jetting fluid 14 is supplied to upper end 22 of tubular mandrel 18 under a pressure sufficient to overcome the biasing force being exerted on plunger valve 26 via spring 44, plunger valve 26 is caused to slidably move within said tubular mandrel 18 so as to uncover at its upper end 38 jetting ports 16, and, at its lower end 40, to simultaneously close bypass port 42 (see FIGS. 2C, 3C & 4C).

Advantageously, in such preferred embodiment using compressible packer 30, packer 30 when compressed in the tool jetting position as shown in FIGS. 2C, 3C, and 4C) seals against casing 12 thereby forcing such pressurized fluid uphole where it can be recycled for re-use, thus preventing loss of abrasive jetting fluid 14 downhole.

Further advantageously, such preferred embodiment also allows use of a selectively actuated bypass port 42, which when open (as normally the case, save during jetting/perforation step) better allows tool 10 to be more easily and quickly inserted into a wellbore by allowing gas and fluid therein to bypass packer 30, which packer 30 even though not compressed during run-in typically effects some seal against casing 12 and thereby in absence of bypass port 42 would detrimentally substantially slow the insertion of tool 10 within a casing 12. Likewise bypass port 42, when open similarly allows, due to elimination of a suction effect by allowing fluid to bypass packer 30, tool 10 to be moved uphole and be removed from within casing 12.

Preferably, although not essential, a wiper plug 65 is positioned below jetting ports 16 and above bypass port 42 and packer 30. Wiper plug 65 inter alia acts and functions as a cup seal, as shown in FIGS. 2C, 3C, and 4C, to reduce or prevent amounts of pressurized abrasive fluid 15 (which typically contains sand) flowing into the region of the bypass port 42. In particular, sand or abrasive fluid 15 if allowed to enter port 42 may otherwise inhibit or prevent movement of plunger valve 26 for purposes of opening and closing jetting ports 16 and bypass port 42, which would thereby render tool 10 inoperative.

In a further embodiment, immediately after perforating a casing 12, the jetting fluid 14 may be ceased to be supplied and in its place a fracking fluid (which may have a formulation different than the pressurized abrasive jetting fluid 14) supplied, so as to immediately allow fracturing of the formation at the location along the casing 12 of the created perforations. Such advantageously and conveniently allows the tool 10 of the present invention to both perforate and subsequently immediately frac the wellbore in the region of the perforations, thus eliminating the need to pull the perforation tool 10 from the well and subsequently insert a fracking tool into the wellbore, thus avoiding the consequent loss in time such step but in the further loss in time in having to align the fracking tool each time longitudinally within the wellbore with the created perforations in the casing 12 in order to effectively frac the wellbore at such locations.

Use of examples in the specification, including examples of terms, is for illustrative purposes only and is not intended to limit the scope and meaning of the embodiments of the invention set out and described in the disclosure. In the specification, the word "comprising" is used as an open-ended term, substantially equivalent to the phrase "including, but not limited to," and the word "comprises" has a corresponding meaning.

The scope of the claims should not be limited by the preferred embodiments set forth in the foregoing examples, but should be given the broadest interpretation consistent with the description as a whole, and the claims are not to be limited to the preferred or exemplified embodiments of the invention.

The embodiments in which an exclusive property and privilege is claimed are set out in the following claims:

1. A perforating tool for perforating a cased wellbore, comprising:

(i) a tubular mandrel;

(ii) a jetting port situated within said tubular mandrel, which jetting port when open allows a jetting fluid from an interior of said tubular mandrel to be radially directed outwardly in a jet;

(iii) a compressible packer member positioned on said tubular mandrel below said jetting port;

(iv) a jaw member, fixedly secured to a pin member, slidably positioned on said tubular mandrel below said packer member and radially outwardly extendable when forced by a wedge-shaped member on said mandrel so as to frictionally engage said cased wellbore;

(v) a 'j' slot for guiding and containing therewithin said in member, said "j' slot located on said tubular mandrel below said packer member and adapted to guide said pin member therein to move from a "run-in" position, subsequently to a "set" position, and lastly to a "jetting" position; and (vi) a bypass port, situated in said tubular mandrel above said compressible packer, when open in said "run-in" position providing fluid communication between an exterior of said tool above said compressible packer and an interior of said tool below said compressible packer;

wherein when said in member in said 'j'-slot is in said "run-in" position said compressible packer member is uncompressed and said jaw member does not forceably frictionally engage said cased wellbore;

wherein when said pin member in said 'j'-slot is repositioned therein from said "run-in" position to said "set" position by pulling in an uphole direction on said tool said tubular mandrel slides upwardly relative to said jaw member; and wherein when said pin member in said 'j'-slot is moved to said "jetting" position said tubular mandrel is allowed to slide relative to said jaw member so as to compress said compressible packer member and further cause said wedge-shaped member on said tubular mandrel to force said jaw member radially outwardly and in frictional engagement with said cased wellbore.

2. A perforating tool for perforating a cased wellbore as claimed in claim 1, further comprising:

(vi) a spring-biased plunger valve, slidably moveable within said tubular mandrel, preventing fluid flow from uphole through said tubular mandrel in a downhole direction, biased via a spring to slidably cover said jetting port, which plunger valve when pressurized jetting fluid is supplied to said upper end of said tubular mandrel at sufficient pressure to overcome said spring bias, slidably moves downward in said tubular mandrel so as to uncover said jetting port and allow said pressurized jetting fluid to flow radially outwardly therefrom and perforate said cased wellbore.

3. The perforating tool as claimed in claim 1 or 2, further comprising:

(viii) wherein said spring-biased plunger valve is a dual-acting plunger valve, biased via said spring to slidably cover said jetting port and to simultaneously leave uncovered said bypass port, but when fluid pressure is supplied to said upper end of said tubular mandrel sufficient to overcome said spring bias, to slidably move within said tubular mandrel to uncover said jetting port and to simultaneously close said bypass port.

4. The perforating tool as claimed in claim 2, further comprising a plurality of jetting ports within a periphery of said tubular mandrel, all in a plane substantially perpendicular to a longitudinal axis of said tubular mandrel.

5. The perforating tool as claimed in claim 4 wherein said plurality of jetting ports are uniformly and circumferentially spaced around said periphery.

6. The perforating tool as claimed in claim 5, wherein an upper portion of said spring-based plunger is an upwardly-facing cone which directs said jetting fluid substantially uniformly to each of said circumferentially-spaced jetting ports.

7. The perforating tool as claimed in claim 1, further comprising:

(vi) a spring-biased plunger valve, slidably moveable within said tubular mandrel, preventing fluid flow from uphole through said tubular mandrel in a downhole direction, biased via said spring, which plunger valve when pressurized jetting fluid is supplied to said upper end of said tubular mandrel at sufficient pressure to overcome said spring bias and said pin in said 'j' slot is moved to said "jetting" position, slidably moves downward in said tubular mandrel and said bypass port is closed and said pressurized jetting fluid flows radially outwardly therefrom and perforates said cased wellbore.

8. A wellbore completion tool for perforating a casing of a cased wellbore, comprising:

(i) a tubular mandrel;

(ii) at least a pair of jetting ports situated at an upper end of said mandrel, positioned within a periphery of said tubular mandrel and in a plane substantially perpendicular to a longitudinal axis of said tubular mandrel;

(iii) a dual-acting spring-biased plunger valve, slidably moveable within said tubular mandrel, preventing fluid flow from uphole through said tubular mandrel in a downhole direction, biased to slidably cover said at least a pair of jetting ports when in a closed position, which when fluid pressure is supplied to said upper end of said tubular mandrel slidably moves to uncover said jetting ports;

(iv) a compressible packer member;

(v) a 'j' slot, located on said mandrel below said packer member, adapted to allow a pin member therein to move in a "run" position, a "set" position, and a "jetting" position;

(vi) a jaw member, positioned on said tubular member below said packer member, radially outwardly extendable when forced by a wedge-shaped element on said mandrel so as to frictionally engage said casing;

(vii) a bypass port situated in said tubular mandrel above said compressible packer;

(viii) a lower portion of said dual-acting plunger valve configured to uncover said bypass port and thereby allow fluid communication between an exterior of the tool uphole of the packer member and a hollow interior of said mandrel below said packer member when said dual-acting valve is in a position covering said jetting ports, and to close said bypass valve when said dual-acting valve is in a position uncovering said jetting ports;

wherein when said pin member in said 'j'-slot is moved to said "run-in" position said compressible packer member is uncompressed and said jaw member does not forceably frictionally engages said cased wellbore; and wherein when said pin in said 'j'-slot is moved to said "jetting" position said wedge shaped member compresses said compressible packer member and further forces said jaw member radially outwardly and in frictional fixed engagement with said cased wellbore.

9. The perforating tool as claimed in claim 8, further having a radial wiper seal extending about the periphery of the tool, positioned on said tool immediately above said bypass port and below said jetting ports.

* * * * *